US012642342B2

(12) United States Patent
Lee et al.

(10) Patent No.: US 12,642,342 B2
(45) Date of Patent: Jun. 2, 2026

(54) COMPACT POWDER CASE

(71) Applicant: SAMHWA CO., LTD, Uiwang-si (KR)

(72) Inventors: Kyung chang Lee, Uiwang-si (KR); Jonghyun Park, Suwon-si (KR); Ga Yeon O, Ansan-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 563 days.

(21) Appl. No.: 18/352,495

(22) Filed: Jul. 14, 2023

(65) Prior Publication Data

US 2024/0358138 A1 Oct. 31, 2024

(30) Foreign Application Priority Data

Apr. 26, 2023 (KR) ..... 10-2023-0054508

(51) Int. Cl.
*A45D 33/20* (2006.01)
*A45D 33/02* (2006.01)

(52) U.S. Cl.
CPC ..... *A45D 33/20* (2013.01); *A45D 33/025* (2013.01)

(58) Field of Classification Search
CPC ..... A45D 33/20; A45D 33/025; A45D 33/22; A45D 33/00; A45D 33/003; A45D 33/006; A45D 33/008; A45D 2200/00; A45D 2200/05; A45D 34/043; A45D 33/34; A45D 33/36; B65D 83/06; B05B 11/00
USPC ..... 222/189.05
See application file for complete search history.

(56) References Cited

U.S. PATENT DOCUMENTS 4,232,718 A * 11/1980 Wippermann ..... G01F 19/002 141/358
2008/0265731 A1* 10/2008 Moon ..... A45D 33/20 312/333
2020/0383453 A1* 12/2020 Jung ..... A45D 40/26

* cited by examiner

*Primary Examiner* — Eric J Rosen
*Assistant Examiner* — Luis Ruiz Martin
(74) *Attorney, Agent, or Firm* — Bridgeway IP Law Group, PLLC; Jihun Kim

(57) ABSTRACT

A compact powder case is disclosed. The compact powder case includes: a storage part that has an inner wall member and a floor member, with a restrictor slit formed in the inner wall member and a supply slit formed in the floor member; a piston that has a first coupler part formed at a position corresponding to the restrictor slit, is movable within the storage space, and is configured to close the supply slit when moved to a first point and open the supply slit when moved to a second point; and a drawer that has a guide member arranged on an outer side of the inner wall member and a tray member arranged on a lower side of the floor member, where the drawer has a second coupler part formed at a position corresponding to the restrictor slit, and the drawer is movable relative to the storage part.

9 Claims, 10 Drawing Sheets

COMPACT POWDER CASE

CROSS-REFERENCE TO RELATED APPLICATIONS

This application claims the benefit of Korean Patent Application No. 10-2023-0054508, filed with the Korean Intellectual Property Office on Apr. 26, 2023, the disclosure of which is incorporated herein by reference in its entirety.

BACKGROUND

1. Technical Field

The present invention relates to a compact powder case, more particularly to a compact powder case that can prevent the powder from contaminating the surrounding area by providing the powder only in fixed amounts during use.

2. Description of the Related Art

A powder product such as a foundation is often provided in a compact powder case. The existing compact powder case, also known as a "compact," typically employs a simple structure that includes a lower case holding the powder product and an upper case hinge-coupled to the lower case. In certain cases, a powder puff is placed over the powder product, and a mirror is mounted on the inner surface of the upper case. Such a compact powder case having a simple structure may be convenient to use due to its small size, but if the case were to be opened unintentionally while being carried in the user's purse or at another inopportune time, the powder content would spill out and create a great mess in the surrounding area.

SUMMARY OF THE INVENTION

An aspect of the present invention, which was conceived to resolve the problem described above, is to provide a compact powder case that can prevent the powder from contaminating the surrounding area by providing the powder only in a fixed amount when the user opens the compact powder case.

Other objectives of the present invention will be more clearly understood from the embodiments set forth below.

A compact powder case according to one aspect of the invention can include: a storage part that has an inner wall member and a floor member defining a storage space for storing a content, where a restrictor slit extending along a front-rear direction is formed in the inner wall member, and a supply slit is formed in the floor member; a piston that has a first coupler part formed at a position corresponding to the restrictor slit, is arranged to be movable along the front-rear direction within the storage space, and is configured to close the supply slit when moved to a first point and open the supply slit when moved to a second point; and a drawer that has a guide member arranged on an outer side of the inner wall member and a tray member arranged on a lower side of the floor member, where the drawer has a second coupler part formed at a position corresponding to the restrictor slit, and the drawer is arranged to be movable along the front-rear direction in relation to the storage part. Here, one of the first coupler part and the second coupler part can include a pin protruding towards the restrictor slit, and the other of the first coupler part and the second coupler part can include a guide slit, through which a portion of the pin may be inserted. A detent can be formed at a predetermined position of the guide slit, and the pin can be configured to pass through the detent when a force exceeding a threshold value is applied. The piston can be positioned at the first point while the drawer is in a rearwardly retracted state, and the piston can be moved to the second point during a process of the drawer being pulled forward from the storage part.

A compact powder case according to an embodiment of the present invention can include one or more of the following features. For example, the first coupler part can include the pin, the second coupler part can include the guide slit, and the guide slit can be formed in a length greater than the length of the restrictor slit. In this case, a tolerance slit can be formed in the guide member at one or more positions within a region encompassing an area above the detent and an area below the detent.

Conversely, the first coupler part can include the guide slit, the second coupler part can include the pin, and the pin can be coupled to the guide member such that the pin is movable along the front-rear direction in relation to the guide member within a range greater than the length of the restrictor slit.

The compact powder case can further include a spring that is coupled to the piston and the storage part to push the piston towards the first point. The compact powder case can further include a sifter member that is coupled at a rear of the piston with a particular distance from the piston, where a through-hole of a particular area can be formed in the sifter member. The compact powder case can further include a mesh member coupled to an upper portion of the tray member.

The storage part can further include an outer wall member that defines a frontwardly open holding space, and the holding space can be configured to hold at least one of the guide member and the tray member.

The compact powder case can further include a lower case defining an upwardly open casing space, where the storage part can be coupled at a rear side of the casing space, and the drawer can be configured to move within the casing space.

An embodiment of the present invention having the features above can provide various advantageous effects including the following. However, an embodiment of the present invention may not necessarily exhibit all of the effects below.

An embodiment of the present invention can considerably reduce the possibility of a powder content contaminating the surrounding area by providing the content only in fixed amounts.

DETAILED DESCRIPTION OF THE INVENTION

Figure 1:
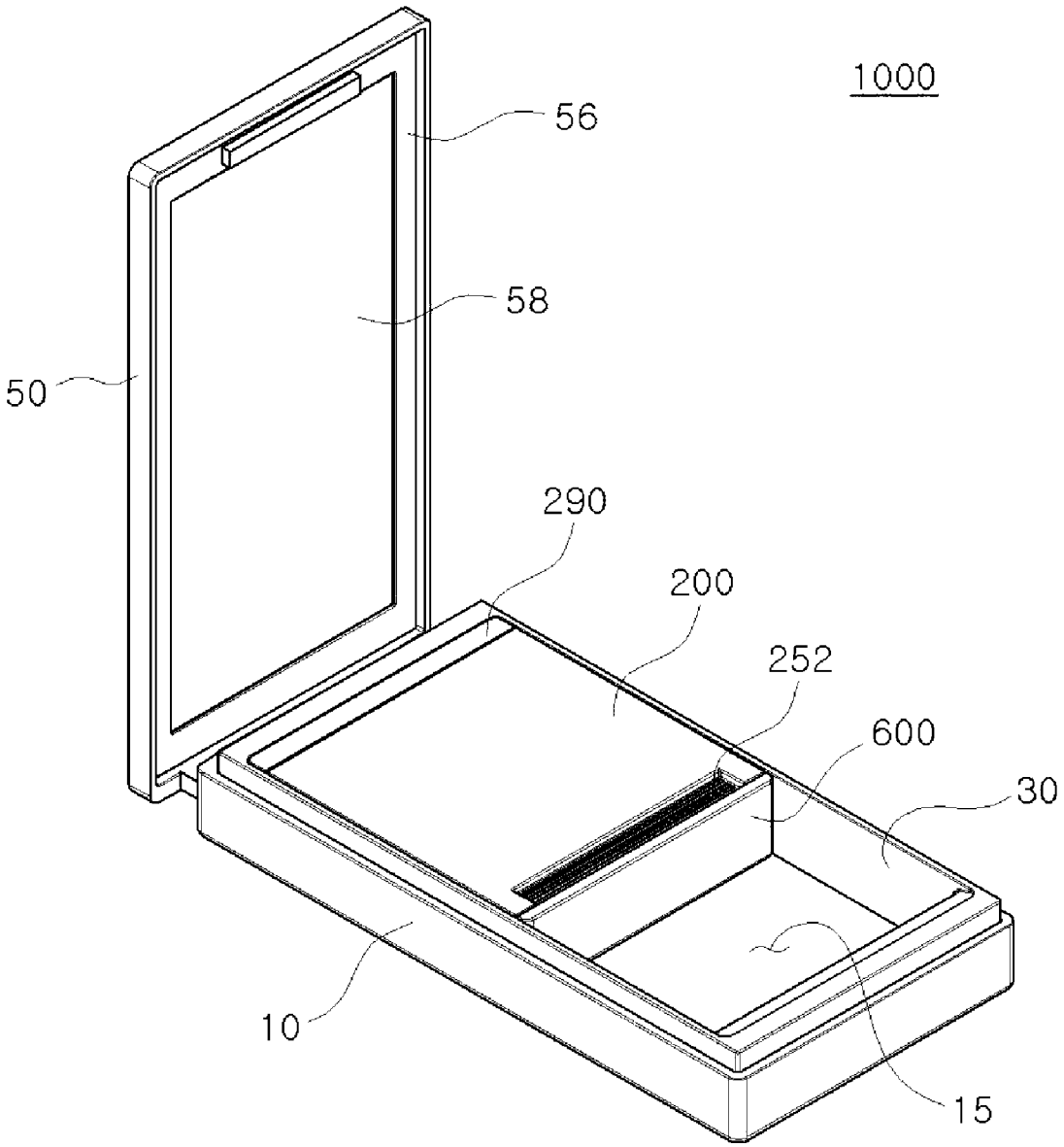
FIG. 1 is a perspective view illustrating a compact powder case according to an embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

For the sake of convenience, the specification uses terms such as "front," "rear," "upper," and "lower." In the descriptions that follow, the "front" refers to the direction in which the drawer 600 is pulled out from the storage part 200, and the "rear" refers to its opposite direction. The terms "upper" and "lower" refer to the upper and lower directions for a compact powder case 1000 oriented as in FIG. 1 and FIG. 2. Of course, during actual use of a compact powder case 1000 according to an embodiment of the invention, the upward direction mentioned in the specification may not necessarily coincide with the actual upward direction.

Figure 2:
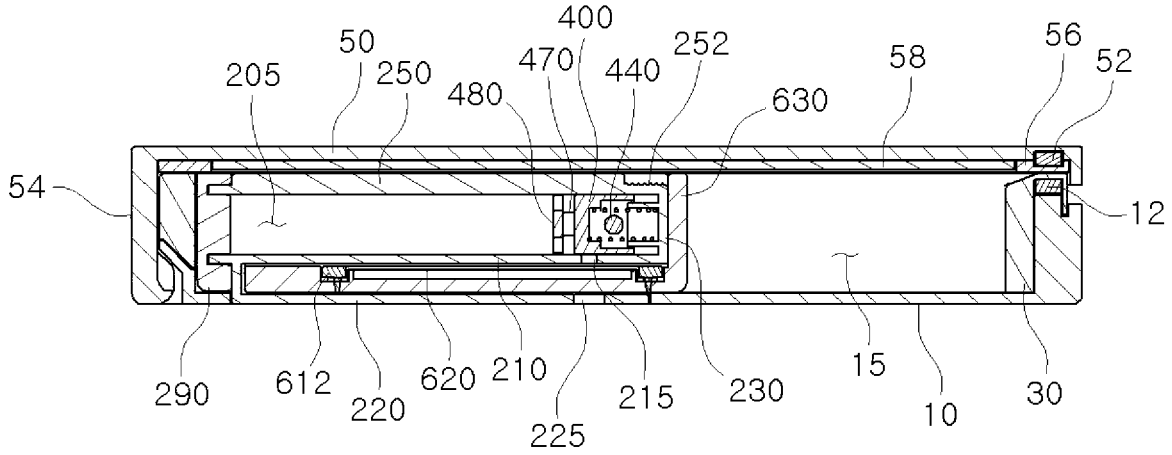
FIG. 2 is a cross-sectional view illustrating the compact powder case shown in FIG. 1.
Figure 3:
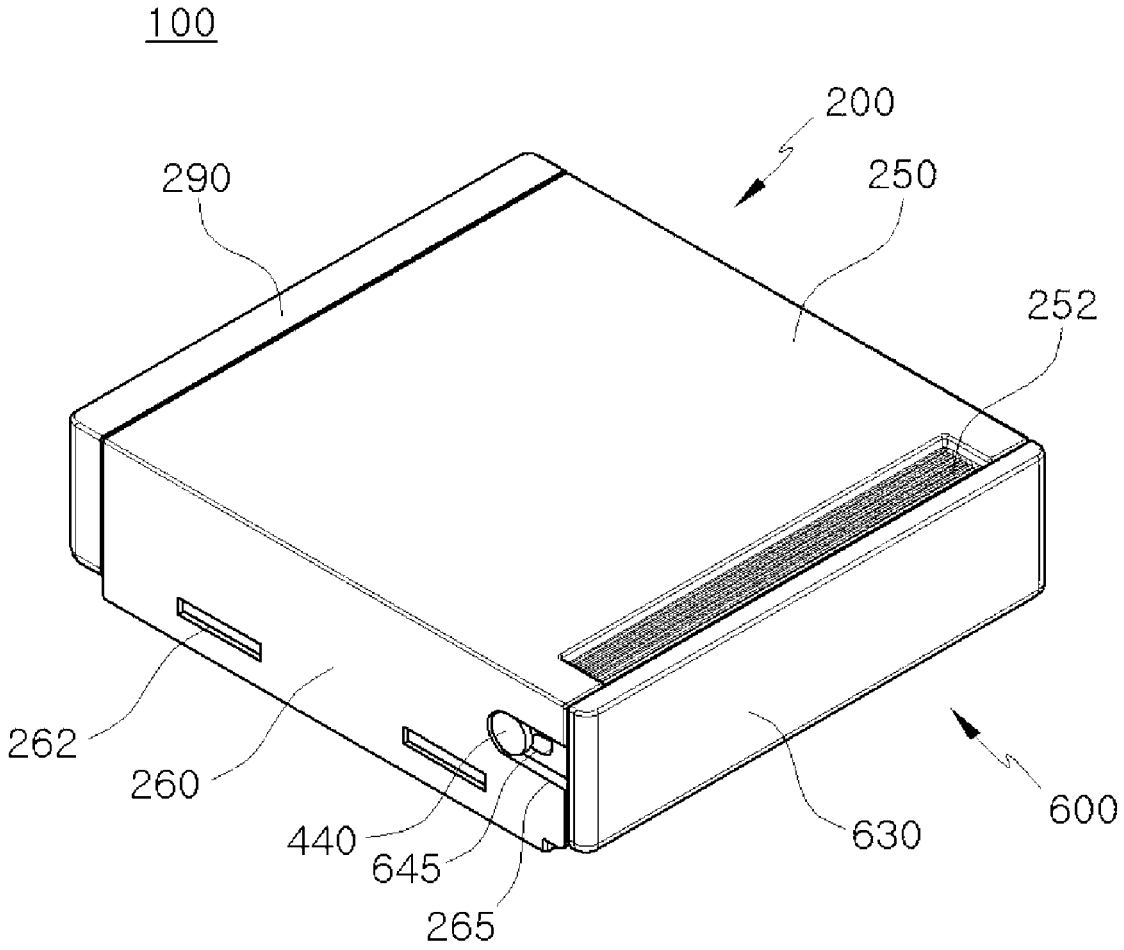
FIG. 3 is a perspective view illustrating the refill unit of a compact powder case according to an embodiment of the invention with the drawer in a retracted state.
Figure 4:
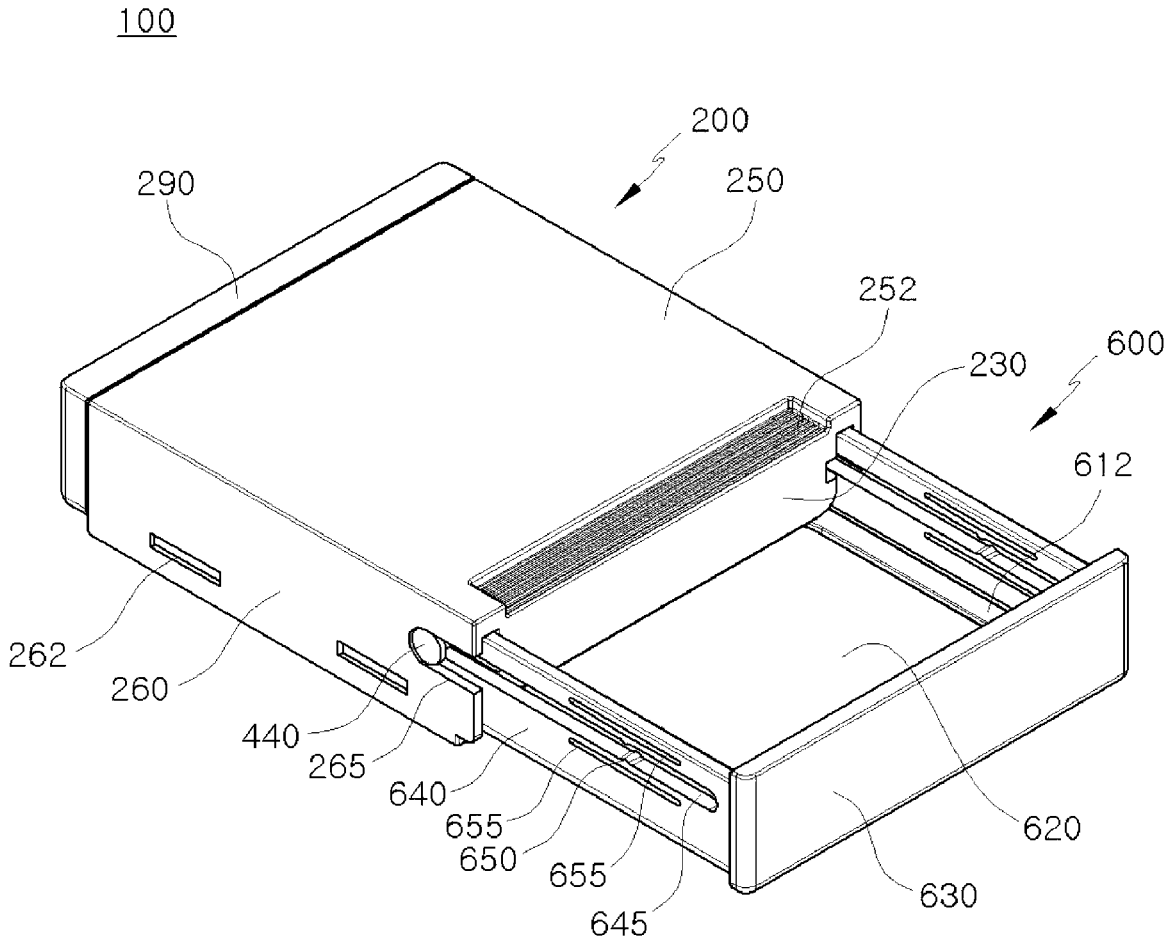
FIG. 4 is a perspective view illustrating the refill unit of a compact powder case according to an embodiment of the invention with the drawer in a pulled-out state.
Figure 5:
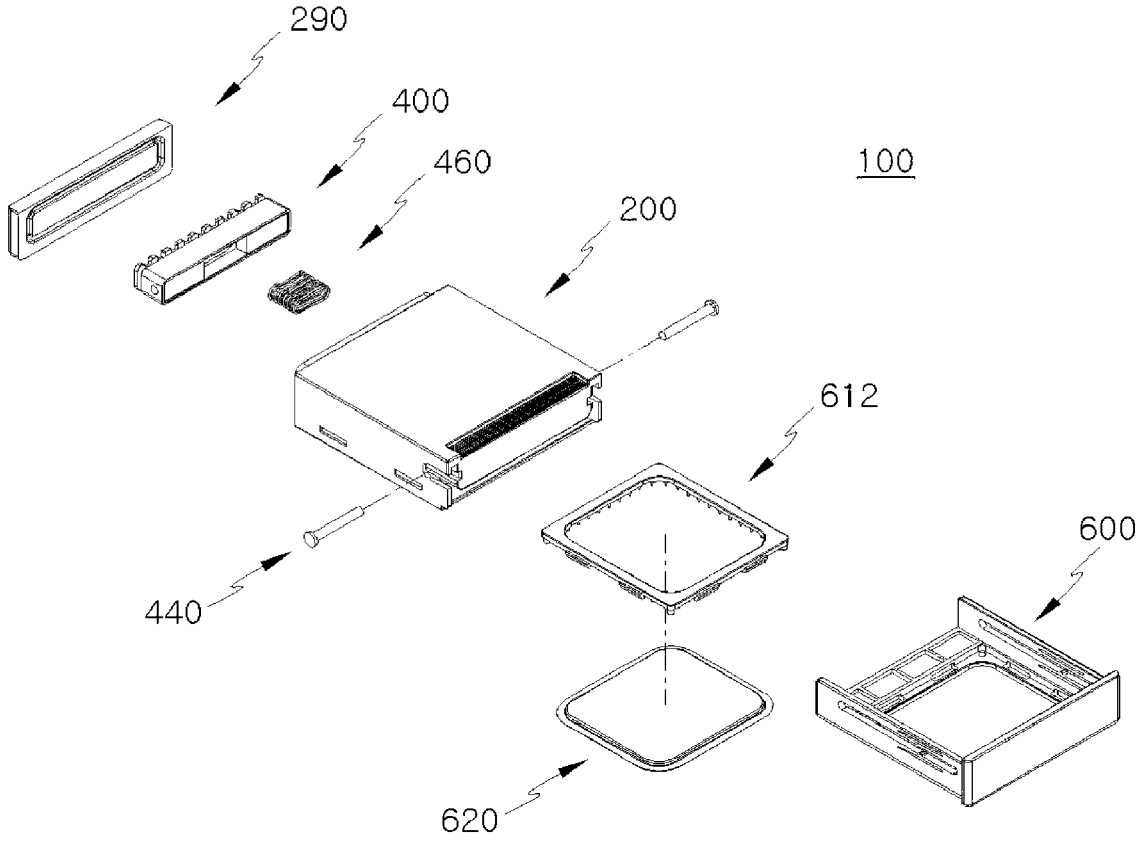
FIG. 5 is an exploded perspective view illustrating the refill unit shown in FIG. 3 and FIG. 4.
Figure 6A:
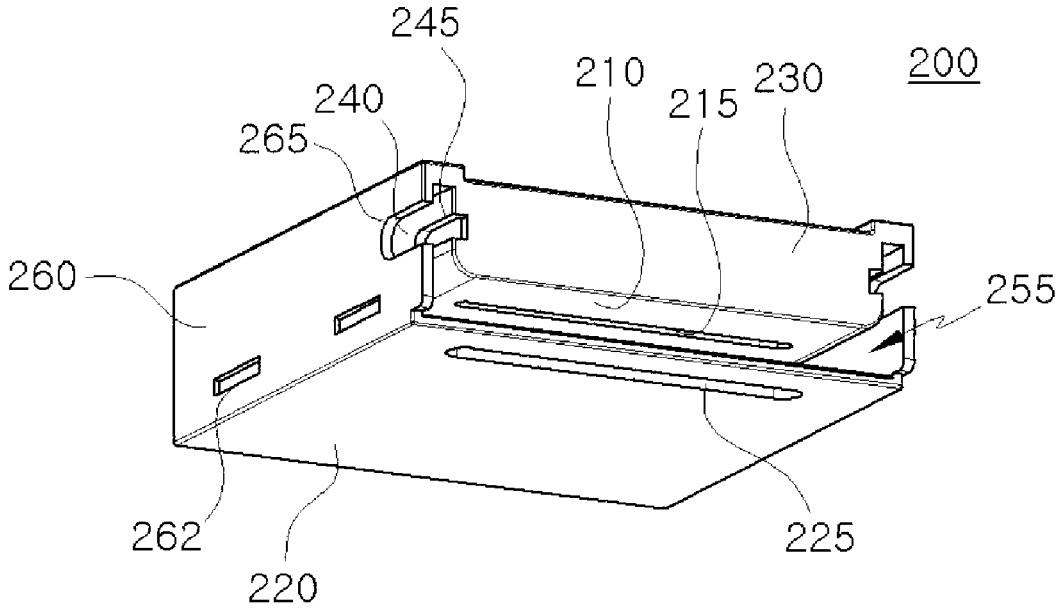
FIG. 6A and FIG. 6B are perspective views illustrating the storage part of a compact powder case according to an embodiment of the invention.
Figure 6B:
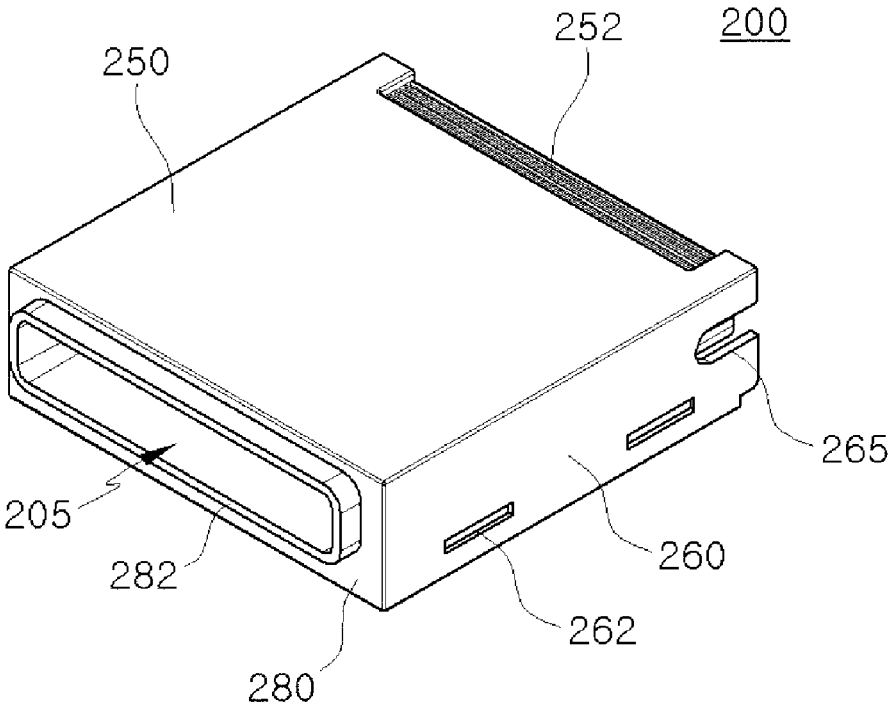
Figure 7A:
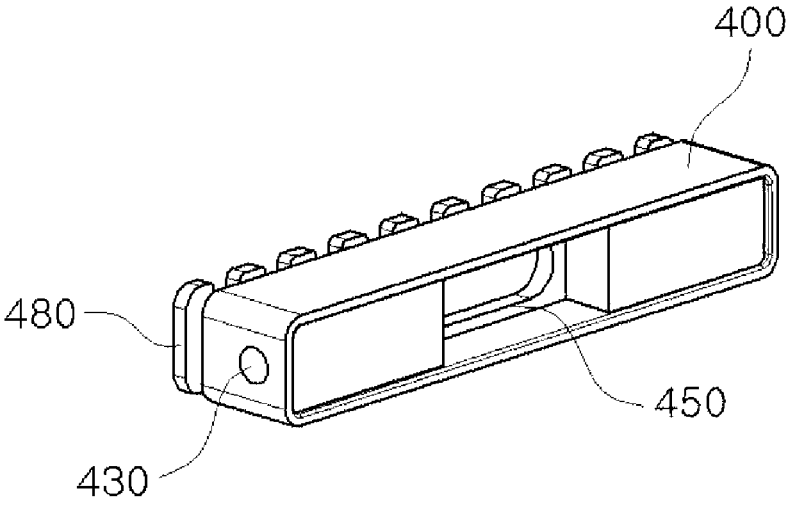
FIG. 7A, FIG. 7B, and FIG. 7C illustrate the piston of a compact powder case according to an embodiment of the invention.
Figure 7B:
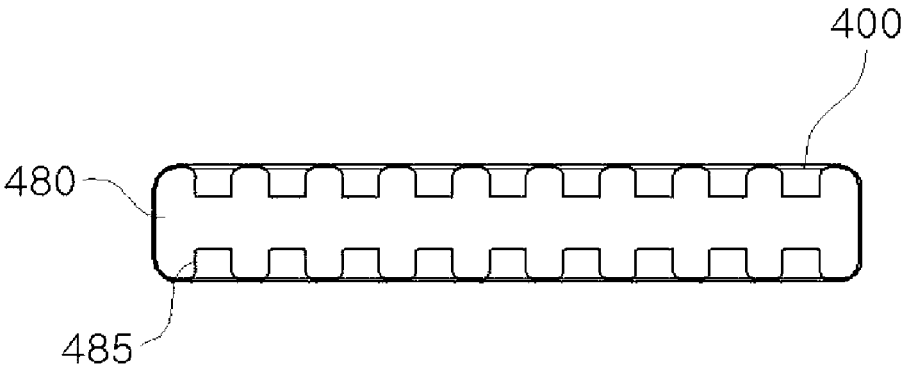
Figure 7C:
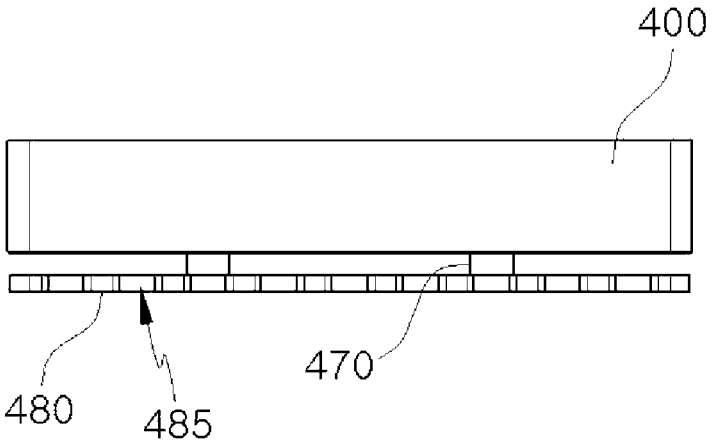

FIG. 1 and FIG. 2 are a perspective view and a cross-sectional view, respectively, illustrating a compact powder case 1000 according to an embodiment of the invention. FIG. 3 and FIG. 4 are perspective views illustrating the refill unit 100 of the compact powder case 1000 with the drawer 600 in a retracted state and in a pulled-out state, respectively. FIG. 5 is an exploded perspective view of the refill unit 100. FIG. 6A and FIG. 6B illustrate the storage part 200, while FIG. 7A, FIG. 7B, and FIG. 7C illustrate the piston 400.

Referring first to FIG. 1 and FIG. 2, a compact powder case 1000 according to an embodiment of the invention can largely include a lower case 10, a middle case 30, an upper case 50, and a refill unit 100.

The lower case 10 can be configured to hold the refill unit 100 inside and, to this end, can define a casing space 15 that is open upwards. Various parts for coupling with the middle case 30, upper case 50, and refill unit 100 can be provided in the lower case 10. In particular, referring to FIG. 2, a through-hole or a recess in which to insert a portion of the refill unit 100 can be formed in a lower surface of the lower case 10, and the refill unit 100 can be aligned and secured at the designed position as a portion of the refill unit 100 is inserted in said through-hole or recess. In a preferred embodiment of the invention, the refill unit 100 can be coupled at a rear side of the casing space 15, so that there is ample space in front of the refill unit 100 within the casing space 15. As described later on, the space in front of the refill unit 100 can not only provide a space for pulling out the drawer 600 of the refill unit 100 but also provide a space for keeping a powder puff (not shown), etc., when the drawer 600 is in a retracted state.

The middle case 30 can be coupled to an inner side of the lower case 10 to limit the casing space 15 to a designated size while aligning and securing the refill unit 100 and other components at their correct positions. For example, as illustrated in FIG. 2, the middle case 30 can be used to mount a lower magnetic member 12 at the front of the compact powder case 1000 (on the right side in FIG. 2). In certain embodiments, the middle case 30 can be fabricated together with the lower case 10 as an integrated body.

The upper case 50 can be coupled to the lower case 10 and can be used to open and close the casing space 15. The upper case 50 can, for example, have the lower end of a back cover 54, which may be formed at the rear, hinge-coupled to the lower case 10. A mirror 58 can be mounted on the surface on one side of the upper case 50, and a mirror frame 56 can be provided for securing the mirror 58. An upper magnetic member 52 can also be mounted on the upper case 50, for example at a position that keeps the upper magnetic member 52 hidden by the mirror frame 56. At least one of the upper magnetic member 52 and the lower magnetic member 12 can be magnetic, and when the upper case 50 is closed, the upper magnetic member 52 and the lower magnetic member 12 can maintain a magnetically coupled state.

The refill unit 100 can serve to store the content 206 and provide a fixed amount of content 26 as manipulated by the user. The refill unit 100 can be arranged and coupled in the casing space 15. The refill unit 100 can include a storage part 200, which is the part that actually stores the content 206, and a drawer 600, which may be pulled out from the storage part 200 to provide a fixed amount of content 206. In a preferred embodiment of the invention, the storage part 200 can be coupled at a rear side of the casing space 15 such that there is ample space remaining in front of the refill unit 100. The front side of the casing space 15 can permit the movement of the drawer 600 and can also be used to hold another object such as a powder puff (not shown), etc.

A more detailed description of the refill unit 100 is provided below with reference to FIG. 3 through FIG. 7C. The name "refill unit" is used merely for convenience and is not intended to limit the invention in any way. That is, while the refill unit 100 most definitely can be used as a refill that is mounted onto the lower case 10, the refill unit 100 is not necessarily limited to a refill purpose. Also, it is possible to omit the lower case 10, middle case 30, and upper case 50 described above and form a compact powder case 1000 according to an embodiment of the invention with only the refill unit 100. A refill unit 100 according to an embodiment of the invention can largely include a storage part 200, a piston 400, and a drawer 600.

The storage part 200 is a part that stores the content 206 and holds the piston 400 and drawer 600. A storage part 200 according to an embodiment of the invention can form a storage space 205, which may be configured to store the content 206, and a holding space 255, which may be configured to hold a portion of the drawer 600. FIG. 6A shows the front of the storage part 200 as seen from a lower viewpoint, while FIG. 6B shows the rear of the storage part 200 as seen from a higher viewpoint. As illustrated in FIG. 6A and FIG. 6B, the storage space 205 can be open at the rear of the storage part 200, and the holding space 255 can be open at the front of the storage part 200.

The storage part 200 can include a floor member 210, a front member 230, inner wall members 240, and an upper member 250, which may define the storage space 205 by forming the lower surface, front surface, side surfaces, and upper surface of the storage space 205, respectively, in the examples illustrated in the drawings. However, the names of these members are assigned merely for convenience, and the invention is not limited by the positions of these members relative to the storage space 205.

The floor member 210 can form the lower surface of the storage space 205, and a supply slit 215 can be formed in the floor member 210. The supply slit 215 may usually be kept closed by the piston 400. However, when the piston 400 is moved and the supply slit 215 is opened due to a manipulation by the user, the content 206 stored in the storage space 205 can fall through the supply slit 215 to be supplied on the tray member 610 of the drawer 600. As illustrated in FIG. 6A, in an embodiment of the invention, the supply slit 215 can extend along the left-right direction. This can allow the content 206 to be uniformly distributed over the tray member 610 rather than being supplied only at a particular point.

Incidentally, although a compact powder case 1000 according to an embodiment of the invention can be used for a content 206 that is a cosmetic of a powder form such as a foundation, the content 206 is not limited to a particular type and does not necessarily have to be of a powder form. The technical spirit of the invention can just as well be applied in cases where the content 206 is one or more of a solid, liquid, and gel.

The front member 230 can form the front surface of the storage space 205. In the example illustrated in the drawings, the front member 230 almost completely closes the front of the storage space 205, so that the content 206 held in the storage space 205 is prevented from leaking out through this part.

The inner wall members 240 are the members in which restrictor slits 245 are formed, from among the members defining the storage space 205. In FIG. 6A, the inner wall members 240 are shown as forming the side surfaces of the storage space 205. That is, FIG. 6A shows the restrictor slits 245 formed in the side members, from among the members defining the storage space 205. However, the restrictor slits 245 do not necessarily have to be formed in the members forming the side surfaces of the storage space 205, and other embodiments are possible in which a restrictor slit 245 is formed, for example, in the members forming the upper surface and/or lower surface of the storage space 205. In cases where the restrictor slit 245 is formed in a member oriented at a different position, the corresponding member would be regarded as the inner wall member 240. For instance, it would be possible to form the restrictor slit 245 in the floor member 210, in which case the floor member 210 would also serve as an inner wall member 240.

The upper member 250 can form the upper surface of the storage space 205. At a front of the upper member 250, a concave portion 252 can be formed that is slightly recessed downward. The concave portion 252 can allow the user to easily grip the front member 630 of the drawer 600 while the drawer 600 is in a retracted state.

The storage part 200 can also include a base member 220, outer wall members 260, and a rear member 280, which may define the holding space 255 by forming the lower surface, side surfaces, and rear surface of the holding space 255, respectively. However, the names of these members are assigned merely for convenience, and the invention is not limited by the positions of these members relative to the holding space 255.

The base member 220 can form the lower surface of the holding space 255 at a position separated from the floor member 210. The tray member 610 of the drawer 600 can move in the gap between the floor member 210 and the base member 220. Since the base member 220 is positioned under the floor member 210 and forms an overlapping structure with the floor member 210, a slit 225 can be formed also in the base member 220, to make it easier to form the supply slit 215 in the floor member 210.

The outer wall members 260 can be formed at a position separated from the inner wall members 240 on the side surfaces of the storage space 205, and thus the holding space 255 can have a "U" shape surrounding the side surfaces and lower surface of the storage space 205. The guide members 640 of the drawer 600 can move in the gap between the inner wall members 240 and the outer wall members 260. However, as already mentioned above, since the inner wall member 240 in which the restrictor slit 245 is formed does not necessarily have to be a member forming a side surface of the storage space 205, the position of the outer wall member 260 and the shape of the holding space 255 can vary according to embodiment. A coupling indentation 262 and/or coupling protrusion (not shown) for coupling the refill unit 100 to the lower case 10 can be formed at a designated position of the outer wall member 260.

A restrictor slit 265 can be formed also in the outer wall member 260, at a position corresponding to the restrictor slit 245 of the inner wall member 240. In the example illustrated in the drawings, the two types of restrictor slits 245, 265 have different widths along the up-down direction, so that the main portion of a pin 440 may be inserted in the restrictor slit 245 of the inner wall member 240 and the head of the pin 440 may be inserted in the restrictor slit 265 of the outer wall member 260. Of course, it is possible for the restrictor slits 245, 265 to have the same width, depending on the composition of the pin 440. Also, in certain embodiments, the restrictor slits 265 of the outer wall members 260 can be omitted. Conversely, in certain embodiments, the restrictor slits 265 of the outer wall members 260 can be used as the main restrictor slits, while the restrictor slits 245 of the inner wall members 240 can be substituted by through-holes that serve merely as clearance holes so as not to obstruct the movement of the pin 440.

The rear member 280 can form the rear surface of the storage space 205 and the holding space 255. In the example illustrated in the drawings, the rear member 280 completely closes off the rear of the holding space 255 but includes an opening at an upper portion that communicates with the storage space 205. A coupling part 252 that protrudes rearward can be provided around the opening communicating with the storage space 205, and a rear cap 290 can be mounted on the coupling part 252. When the refill unit 100 is assembled, the spring 460, piston 400, etc., can be inserted and arranged in the storage space 205, the content 206 can be filled, and afterwards the rear cap 290 can be mounted onto the coupling part 252 to seal the rear side of the storage space 205.

The holding space 255 of the storage part 200 provides a space in which the tray member 610 and guide members 640 of the drawer 600 can move at positions adjacent to the floor member 210 and inner wall members 240 of the storage part 200. In certain embodiments, some or all of the base member 220 and outer wall members 260 of the storage part 200 can be omitted, and the holding space 255 can be formed by the space between the floor member 210 of the storage part 200 and the lower case 10 and the spaces between the inner wall members 240 and the side walls of the middle case 30. Of course, if the storage part 200 does include the base member 220 and outer wall members 260 such that the holding space 255 is formed within the storage part 200, then the storage part 200 together with the coupled drawer 600 can form an individual assembly, so that the refill unit 100 may be individually manufactured and distributed, etc., as an independent structure.

The piston 400 can be arranged so as to be movable along the front-rear direction within the storage space 205. The piston 400 may normally be positioned at a first point from which the piston 400 may close the supply slit 215, but when the drawer 600 is pulled forward from the storage part 200 due to a manipulation by the user, the piston 400 may be moved to a second point during the process. When the piston 400 is at the second point, the supply slit 215 can be opened, and the content 206 within the storage space 205 can fall through the supply slit 215 onto the tray member 610 of the drawer 600. FIG. 7A is a perspective view showing the front of the piston 400, FIG. 7B is a rear view of the piston 400, and FIG. 7C is a top view of the piston 400. In FIGS. 7A to 7C, the pin 440 forming a part of the coupler part of the piston 400 is omitted.

The piston 400 can be formed in a size that can close the supply slit 215 of the storage part 200. A first coupler part can be formed on the piston 400 at a position corresponding to the restrictor slit 245 of the storage part 200, where the first coupler part can be configured to operate in engagement with a second coupler part formed on the drawer 600. In cases where the restrictor slit 245 is formed in an inner wall member 240 forming a side surface of the storage space 205 as in the embodiment illustrated in the drawings, the first coupler part can correspondingly include pins 440, which may be inserted in pin-coupling indentations 430 formed in both sides of the piston 400.

Figure 8A:
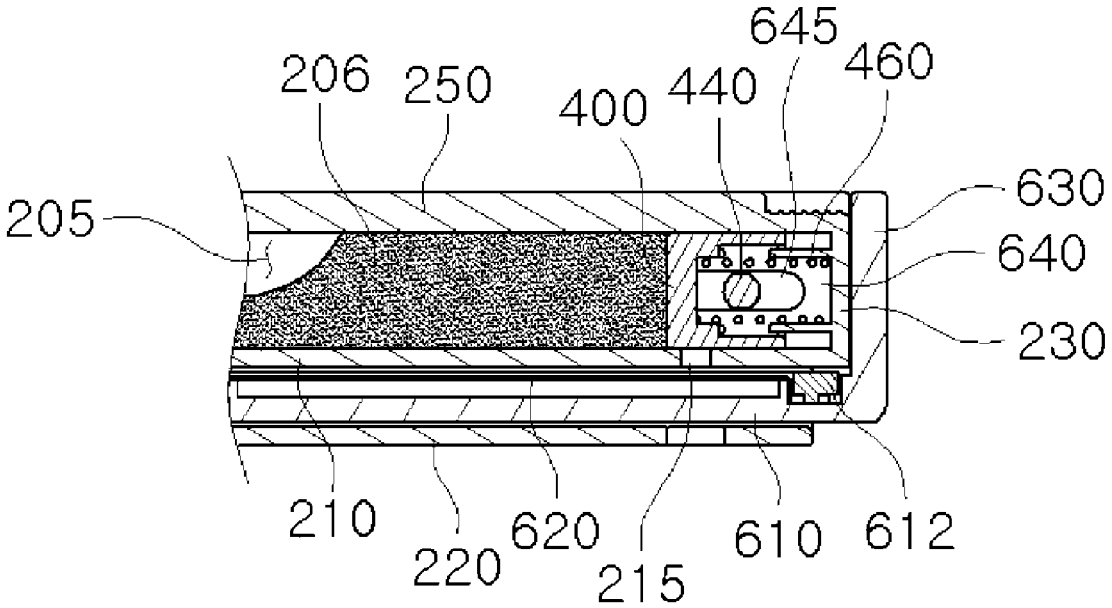
FIG. 8A, FIG. 8B, and FIG. 8C are conceptual diagrams illustrating the operation of a compact powder case according to an embodiment of the invention.
Figure 8B:
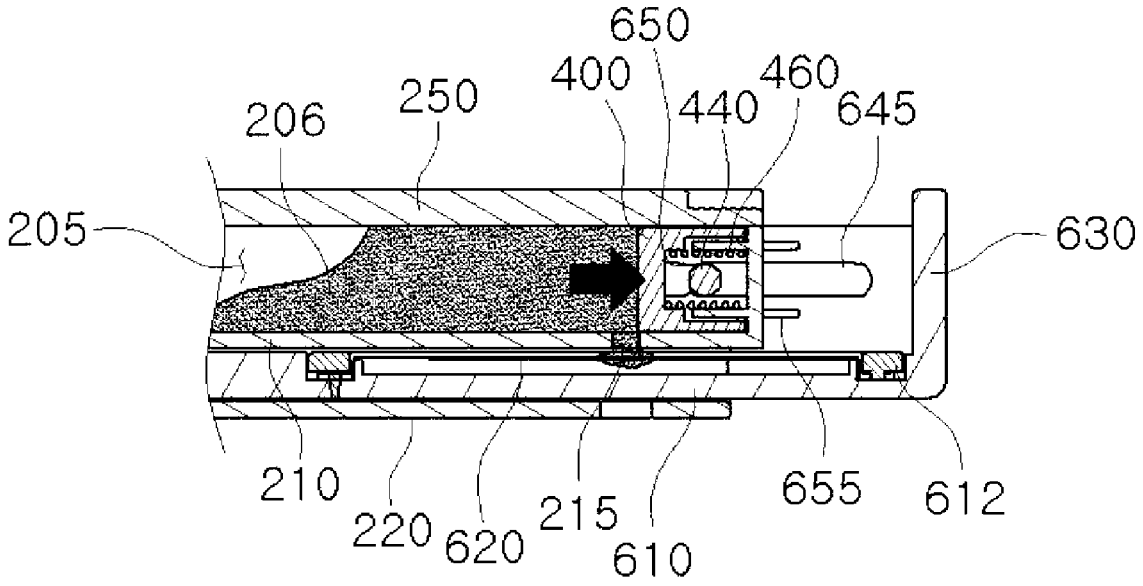
Figure 8C:
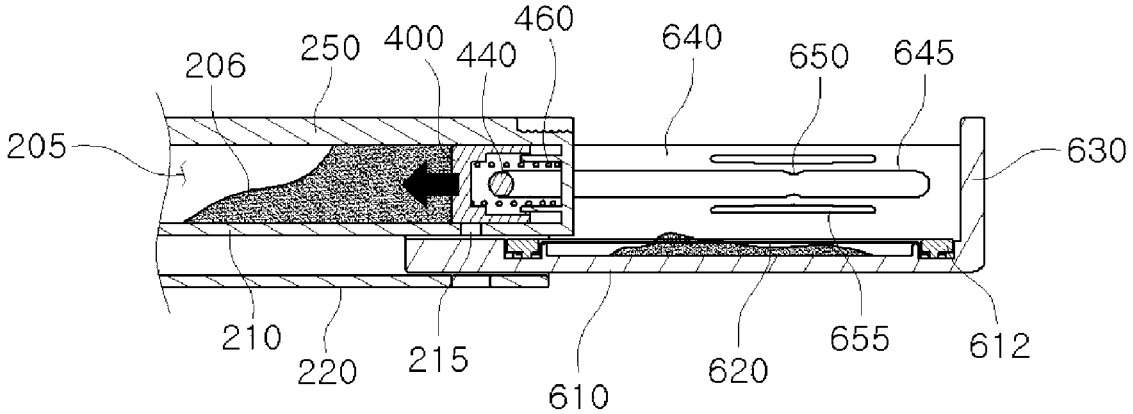

A spring-mounting part 450 can be provided on the front of the piston 400. The spring-mounting part 450 may correspond to a structure for mounting the spring 460 and, in the example illustrated in the drawings, is implemented in the form of a recess into which a portion of the spring 460 may be inserted. Of course, the spring-mounting part 450 can also be implemented as a protrusion, with the spring 460 mounted onto its outer perimeter, or as any of a variety of forms. As illustrated in FIGS. 8A to 8C, a spring-mounting part for securing the other end of the spring 460 can be provided on the rear of the front member 230 of the storage part 200 as well.

The spring 460 can be coupled to the piston 400 and to the storage part 200 and can serve to push the piston 400 such that the piston 400 remains at the first point for closing the supply slit 215. In the embodiment illustrated in the drawings, the spring 460 is arranged between the piston 400 and the front member 230 within the storage space 205 to push the piston 400 rearward. It is possible to omit the spring 460 in certain embodiments, but in such cases, the operating method of the piston 400 may be slightly different.

As illustrated in FIGS. 7A to 7C, a sifter member 480 can be provided at the rear of the piston 400. The sifter member 480 can be coupled to the piston 400 with a certain distance in-between, where a connecting part 470 of any of a variety of structures can connect the piston 400 with the sifter member 480. Through-holes 485 of a particular area can be formed in the sifter member 480, and in a preferred embodiment of the invention, at least some of the through-holes 485 can be formed in a lower portion of the sifter member 480. The functions of the sifter member 480 and other elements of the piston 400 will be described later on in further detail with reference to FIGS. 8A to 8C.

The drawer 600 can be coupled to the storage part 200 such that it is movable along the front-rear direction. In the present specification, reference to the drawer 600 being in a retracted state is intended to mean that the drawer 600 has been moved rearward as much as is possible. The drawer 600 is the part that the user pulls on when the user wishes to use the content 206. When pulled out by the user, the drawer 600 manipulates the piston 400 to cause the content 206 to fall and at the same time catches the fallen content 206 to allow access by the user. A drawer 600 according to an embodiment of the invention can include a tray member 610, a front member 630, and guide members 640.

The tray member 610 can be inserted into the holding space 255 under the floor member 210 of the storage part 200. The tray member 610 can be shaped overall as a thin plate and can be made with a material and structure that does not create a large friction against the base member 220 of the storage part 200. When the piston 400 is moved to the second point during the process of the drawer 600 being pulled out, the content 206 that falls through the supply slit 215 can land on the tray member 610.

On an upper portion of the tray member 610, a mesh member 620 can additionally be provided, as well as a mesh frame 612 for securing the mesh member 620 onto the tray member 610. The mesh member 620 can take the form of a mesh having numerous tiny holes and can be made with relative flexibility rather than having a high rigidity. The mesh frame 612 can support this flexible mesh member 620 such that the flexible mesh member 620 maintains a flat orientation at a height separated from the tray member 610. In cases where the mesh member 620 is included, the content 206 that is supplied through the supply slit 215 can either be provided only on the mesh member 620 above the tray member 610 or be provided on both the tray member 610 and the mesh member 620, depending on the size of the holes of the mesh member 620. Of course, in certain embodiments, the mesh frame 612 and the mesh member 620 can be omitted.

The front member 630 is the part extending upward from a front side of the tray member 610. The front member 630 can serve as the part by which the user may easily grip the drawer 600 and can provide a smooth exterior when the drawer 600 is in a retracted state. In an embodiment of the invention, the front member 630 can extend to a height corresponding to the upper surface of the upper member 250 of the storage part 200. As described above, a concave portion 252 may be formed in the upper member 250 of the storage part 200 to allow the user to more easily grip the front member 630. In cases where the concave portion 252 is omitted, it is possible to have the front member 630 extend to a position higher than the upper member 250.

The guide members 640 can be inserted into the holding space 255 at the outer sides of the inner wall members 240.

A guide member 640 can be shaped overall as a thin plate and can be made with a material and structure that does not create a large friction against the outer wall member 260 and inner wall member 240 of the storage part 200.

Second coupler parts can be formed on the guide member 640 at positions corresponding to the restrictor slits 245 of the storage part 200, where a second coupler part can be configured to operate in engagement with the first coupler part formed on the piston 400. In cases where the restrictor slits 245 are formed in the inner wall members 240 forming the side surfaces of the storage space 205 as in the embodiment illustrated in the drawings, the second coupler parts can include guide slits 645 formed in both sides of the guide members 640 at the same height as the restrictor slits 245.

A guide slit 645 may be a slit formed in the guide member 640 and can extend in an elongated manner along the front-rear direction. The guide slit 645 can be formed in a length greater than the length of the restrictor slit 245. In cases where a pin 440 is coupled to the piston 400 as the first coupler part, as in the example illustrated in the drawings, a portion of the pin 440 can be positioned within the guide slit 645. When the drawer 600 is pulled out, the pin 440 can pass through the guide slit 645 along the front-rear direction, and the drawer 600 can move within a range corresponding to the length of the guide slit 645.

A detent 650 can be formed at a particular position of the guide slit 645. The detent 650 may correspond to a portion of the guide slit 645 that is harder for the pin 440 to pass through compared to the remaining portions of the guide slit 645. The pin 440 can pass through the detent 650 only when a force exceeding a particular threshold value is applied, whereas the pin 440 can readily pass through other portions of the guide slit 645 when a force is applied that is smaller than or equal to the threshold value. Incidentally, in cases where the compact powder case 1000 includes a spring 460 mounted within the storage space 205, the spring 460 can be designed such that the force applied on the piston 400 by the spring 460 does not exceed the threshold value required for the pin 440 to pass through the detent 650.

As one example, in the structure shown in FIG. 4 and FIG. 5, the detent 650 is implemented as a portion that has been narrowed in width along the up-down direction compared to other portions of the guide slit 645. When the drawer 600 is moved relative to the storage part 200, the drawer 600 can move without applying a force on the pin 440, because the guide slit 645 is formed at a position corresponding to the pin 440, until the detent 650 reaches the pin 440. When the detent 650 arrives at the pin 440, the pin 440 cannot easily pass through the detent 650, so that the drawer 600, or more specifically the detent 650 of the drawer 600, may apply a force on the pin 440.

The detent 650, which may be formed as a portion of the guide slit 645 that is narrowed in width along the up-down direction, would contact the pin 440 every time the drawer 600 is manipulated. Therefore, in order to prevent wear of the detent 650 and in order that pushing the pin 440 through the detent 650 may not require an excessive force, a tolerance slit 655 can be formed in the guide member 640 at one or more positions above and below the detent 650. The tolerance slit 655 can be formed in a particular length along the front-rear direction with its center aligned with the detent 650. The tolerance slit 655 enables the guide member 640 to expand above and below the detent 650 when the detent 650 arrives at the pin 440, allowing the pin 440 to pass through the detent 650 more easily.

A more detailed description is provided below, with reference to FIG. 1 through FIG. 8C, on how the refill unit 100 is operated when the user uses the compact powder case 1000. FIGS. 8A to 8C are conceptual diagrams illustrating the operation of a compact powder case 1000 according to an embodiment of the invention, and certain elements are omitted in FIGS. 8A to 8C to allow a better understanding of the invention.

First, the user can separate the upper case 50 from the lower case 10 as in FIG. 1. As described above, a mirror 58 can be mounted on a surface of the upper case 50, and a powder puff (not shown), etc., can be stored in the casing space 15 of the lower case 10 in front of the refill unit 100. The user can take out the powder puff (not shown) and pull the front member 630 of the drawer 600 forward to be supplied with the content 206.

Referring to FIG. 8A, in the state before the user starts pulling out the drawer 600, the piston 400 is at the first point. This is a state in which the piston 400 closes the supply slit 215, and the content 206 may not be provided through the supply slit 215. Although the inner wall members 240 of the storage part 200 are not shown in FIGS. 8A to 8C, the pins 440 coupled to the piston 400 can be positioned at the rear ends of the restrictor slits 245 in the inner wall members 240 when the piston 400 is at the first point. Therefore, even if a spring 460 is provided to push the piston 400 rearward, the piston 400 may not be pushed further rearward beyond the first point.

When the user begins to pull out the drawer 600, the drawer 600 may not apply any force on the pins 440, since the pins 440 can pass through the guide slits 645. Therefore, even though the drawer 600 is moved, the piston 400 can remain unmoved at the first point. Here, the pins 440 can still be positioned at the rear ends of the restrictor slits 245.

Referring to FIG. 8B, as the user pulls out the drawer 600 and the pins 440 pass through the guide slits 645, the detents 650 may eventually arrive at the pins 440. The pins 440 can only pass through the detents 650 if a force exceeding a threshold value is applied, and the spring 460 can be configured to apply a force on the piston 400 that does not exceed this threshold value. Therefore, the detents 650 may push the pins 440 forward, and the piston 400 coupled to the pins 440 can be pushed forward as well to move to the second point. When the piston 400 is at the second point, the supply slit 215 can be opened, and the content 206 stored in the storage space 205 can fall down through the supply slit 215.

Although it is not shown in FIGS. 8A to 8C, a sifter member 480 can be provided to the rear of the piston 400 with a slight distance in-between, as already described above. Even if the storage space 205 is full of the content 206, the sifter member 480 can prevent the content 206 from passing through the supply slit 215 in an excessive amount when the supply slit 215 is opened. Through-holes 485 of a particular area can be formed in the sifter member 480 such that a suitable amount of content 206 may be prepared between the sifter member 480 and the rear surface of the piston 400. Also, when the piston 400 is moved to the second point and the supply slit 215 is opened, a portion of the sifter member 480 can serve to sweep the content 206 between the sifter member 480 and the piston 400 towards the supply slit 215.

The content 206 that falls through the supply slit 215 can be supplied on the tray member 610 of the drawer 600. In cases where a mesh member 620 is provided on the tray member 610, the content 206 can be supplied on the mesh member 620. The tray member 610 or the mesh member 620 can be configured so as not be separated from the floor member 210 of the storage part 200 by a great distance, and this structure can serve both to prevent the supply of content 206 in an excessive amount and to evenly spread out the content 206 supplied on the tray member 610 and/or mesh member 620.

When the user continues pulling out the drawer 600 such that the pins 440 and the piston 400 are pulled forward as well by the detents 650, the pins 440 may be positioned at the front ends of the restrictor slits 245. In this state, the pins 440 are unable to move forward any further.

Referring to FIG. 8C, as the user continues pulling out the drawer 600 while the pins 440 are no longer in a movable state, the force applied on the pins 440 may finally exceed the threshold value, and the pins 440 may pass through the detents 650 of the guide slits 645. In cases where there are tolerance slits 655 formed above and/or below the detents 650, the detents 650 can slightly recede upward and/or downward as the pins 440 pass through. Once the pins 440 pass through the detents 650, the drawer 600 is again no longer able to apply a force on the pins 440, and the pins 440 may again be pushed rearward by the force of the spring 460, and the piston 400 may move back to the first point. When the piston 400 is moved to the first point, the sifter member 480 can push the content 206 rearward, and only some of the content 206 can pass through the through-holes 485 formed in the sifter member 480 to be prepared between the sifter member 480 and the piston 400.

When the drawer 600 is completely pulled out, a certain amount of content 206 supplied on the tray member 610 and/or mesh member 620 may be exposed to the outside. The user can use the content 206 such as by dabbing it with a powder puff (not shown), etc. In cases where a mesh member 620 having fine holes are used, some of the content 206 may pass through the holes of the mesh member 620 to be provided on the tray member 610, and this can prevent the content 206, which is of a powder form, from dispersing into the air. If the user uses a powder puff (not shown), the powder puff (not shown) can push the mesh member 620 or pass through the holes of the mesh member 620 such that the content 206 on the tray member 610 gets on the powder puff (not shown).

After the user has used the content 206 on the tray member 610, the user can push the drawer 600 back rearward such that the drawer 600 may be retracted in the holding space 255 of the storage part 200. While there would be a slight resistance during this process also when the detents 650 arrive at the pins 440, the piston 400 would not move away from the first point. The user can place the powder puff (not shown), etc., in front of the retracted front member 630 and close the upper case 50 for keeping the compact powder case 1000.

As described above, a compact powder case 1000 according to an embodiment of the invention may not necessarily include a spring 460. In cases where the spring 460 is omitted, the detents 650 can pull the pins 440 and move the piston 400 to the second point such that the supply slit 215 is opened, during the process of the user pulling the drawer 600 out forward, and after the pins 440 pass through the detents 650, the piston 400 may remain at the second point. When the drawer 600 is completely open, a portion of the tray member 610 can block the bottom of the supply slit 215 to prevent any more of the content 206 from falling. When the user closes the drawer 600 again after using the content 206, the detents 650 can push the pins 440 back rearward such that the piston 400 moves to the first point, thereby closing the supply slit 215.

Although the descriptions above focus mainly on examples where the pins 440 are formed on the piston 400 as the first coupler part and the guide slits 645 are formed in the drawer 600 as the second coupler part, it is possible to have the first coupler part include the guide slits and the second coupler part include the pins. In other words, it is possible to implement a structure in which the positions of the pins 440 and the guide slits 645 are exchanged, such that the guide slits are formed in the piston 400 and the pins are formed on the drawer 600. Of course, in this case, slight modifications can be made to the shapes and structures of the pins 440 and guide slits 645.

For example, the guide slits formed in the piston 400 can be formed with a much shorter length, and the pins formed on the drawer 600 can be movably coupled to the guide members 640 such that the pins are movable in relation to the guide members 640 along the front-rear direction within a range that is greater than the length of the restrictor slits 245. When the drawer 600 is pulled out, the pins of the drawer 600 can remain in the same position, moving only in relation to the guide members 640, and the piston 400 can be positioned at the second point at which the supply slit 215 is opened. Once the pins of the drawer 600 reach the end of its movable range relative to the guide members 640, the pins may apply a force on the guide slits of the piston 400 to move the piston 400 to the first point and thereby close the supply slit 215.

One of the advantages of having the pins 440 formed on the piston 400 as the first coupler part, having the guide slits 645 formed in the drawer 600 as the second coupler part, and having a spring 460 between front member 230 of the storage part 200 and the piston 400, as in the example illustrated in FIGS. 1 to 8C, is that the supply slit 215 can be opened only momentarily at a certain time after the drawer 600 begins to be pulled out and before the drawer 600 is completely pulled out. This makes it possible to dispense only a certain amount of content 206, which may be in the form of a powder, gel, liquid, etc., and to keep the storage space 205 closed when the drawer 600 is in a completely open state. This can significantly lower the possibility of the content 206 landing at a nearby location and causing contamination. In addition, the sifter member 480 of the piston 400 can adjust the amount of content 206 passing through the supply slit 215 such that the amount is neither too much nor too little, while the tray member 610 and the mesh member 620 can evenly spread out the dispensed content 206 for convenient use by the user.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A compact powder case comprising:

a storage part having an inner wall member and a floor member, the inner wall member and the floor member defining a storage space for storing a content, the inner wall member having a restrictor slit formed therein, the restrictor slit extending along a front-rear direction, the floor member having a supply slit formed therein;

a piston having a first coupler part formed at a position corresponding to the restrictor slit, the piston arranged to be movable along the front-rear direction within the storage space and configured to close the supply slit when moved to a first point and open the supply slit when moved to a second point; and a drawer having a guide member and a tray member, the guide member arranged on an outer side of the inner wall member, the tray member arranged on a lower side of the floor member, the drawer having a second coupler part formed at a position corresponding to the restrictor slit, the drawer arranged to be movable along the front-rear direction in relation to the storage part, wherein one of the first coupler part and the second coupler part includes a pin protruding towards the restrictor slit, another of the first coupler part and the second coupler part includes a guide slit configured to receive a portion of the pin inserted therethrough, a detent is formed at a predetermined position of the guide slit, the pin is configured to pass through the detent when a force exceeding a threshold value is applied, the piston is positioned at the first point while the drawer is in a rearwardly retracted state, and the piston is moved to the second point during a process of the drawer being pulled forward from the storage part.

2. The compact powder case of claim 1, wherein the first coupler part includes the pin, the second coupler part includes the guide slit, and the guide slit is formed in a length greater than a length of the restrictor slit.

3. The compact powder case of claim 2, wherein a tolerance slit is formed in the guide member at one or more positions within a region encompassing an area above the detent and an area below the detent.

4. The compact powder case of claim 1, wherein the first coupler part includes the guide slit, the second coupler part includes the pin, and the pin is coupled to the guide member such that the pin is movable along the front-rear direction in relation to the guide member within a range greater than a length of the restrictor slit.

5. The compact powder case of claim 1, further comprising:

a spring coupled to the piston and the storage part to push the piston towards the first point.

6. The compact powder case of claim 1, further comprising:

a sifter member coupled at a rear of the piston with a particular distance from the piston, the sifter member having a through-hole of a particular area formed therein.

7. The compact powder case of claim 1, further comprising:

a mesh member coupled to an upper portion of the tray member.

8. The compact powder case of claim 1, wherein the storage part further comprises an outer wall member defining a frontwardly open holding space, the holding space configured to hold at least one of the guide member and the tray member.

9. The compact powder case of claim 1, further comprising:

a lower case defining an upwardly open casing space, wherein the storage part is coupled at a rear side of the casing space, and the drawer is configured to move within the casing space.

* * * * *